US007090552B2

(12) United States Patent
Katayama

(10) Patent No.: US 7,090,552 B2
(45) Date of Patent: Aug. 15, 2006

(54) INTAKE SYSTEM FOR OUTBOARD ENGINE

(75) Inventor: Goichi Katayama, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 105 days.

(21) Appl. No.: 10/880,184

(22) Filed: Jun. 29, 2004

(65) Prior Publication Data

US 2005/0003718 A1 Jan. 6, 2005

(30) Foreign Application Priority Data

Jul. 2, 2003 (JP) ..... 2003-190313

(51) Int. Cl.
*B63H 20/00* (2006.01)
*B63H 21/14* (2006.01)
*F02M 35/10* (2006.01)

(52) U.S. Cl. ..... 440/88 A; 123/184.21; 123/184.47

(58) Field of Classification Search ..... 440/88 A, 440/88 R; 123/184.21, 184.47, 184.48, 184.49
See application file for complete search history.

(56) References Cited

U.S. PATENT DOCUMENTS 4,784,090 A 11/1988 Sougawa
5,816,209 A * 10/1998 Kato ..... 123/184.59
5,894,831 A 4/1999 Takahashi et al.
5,957,112 A 9/1999 Takahashi et al.
6,019,078 A 2/2000 Kimura et al.
6,032,638 A 3/2000 Kato
6,109,231 A 8/2000 Watanabe et al.
6,142,842 A 11/2000 Watanabe et al.
6,220,217 B1 4/2001 Kato
6,427,655 B1 * 8/2002 Itoh et al. ..... 123/184.42
6,460,407 B1 10/2002 Kato
6,736,110 B1 5/2004 Kato
6,752,114 B1 6/2004 Ochiai et al.

* cited by examiner

*Primary Examiner*—Ajay Vasudeva
(74) *Attorney, Agent, or Firm*—Knobbe, Martens, Olson & Bear LLP

(57) ABSTRACT

An air intake system for an engine of an outboard motor includes air intake plenum chambers and corresponding air intake passages. Residual condensed fuel that can accumulate in the plenum chamber is guided to lower air intake passages through a slot at a predetermined rate to be delivered to combustion chambers inside the engine. The air intake system can reduce the likelihood that the plenum chambers will accumulate residual fuel above an acceptable amount and can allow the residual fuel to be more slowly delivered to the engine so as to evacuate the fuel without substantially altering the desired air/fuel ratio.

13 Claims, 6 Drawing Sheets

INTAKE SYSTEM FOR OUTBOARD ENGINE

PRIORITY INFORMATION

This application is based on and claims priority to Japanese Patent Application No. 2003-190313, filed Jul. 2, 2003, the entire contents of which is hereby expressly incorporated by reference.

FIELD OF THE INVENTION

The present invention relates generally to an air intake system for an engine and, more particularly, to an improved air intake system that drains liquid fuel from an intake plenum of the air intake system.

DESCRIPTION OF THE RELATED ART

Outboard motors typically are connected to a transom of a watercraft. The outboard motors are designed to be steerable (i.e., left and right movement) relative to the transom. The outboard motors also are designed to be capable of tilting and trimming movement relative to the transom.

Most outboard motors contain an internal combustion engine. The engine draws air from within the housing or shroud of the outboard motor through an air intake system. Typically, the air intake system features a surge tank, or plenum chamber, to which air intake runners can be connected. Generally, the lowermost runner is positioned above a lower wall of the plenum chamber such that a step exists between the runner and the lower wall.

During operation of the engine, a small portion of the fuel can drop from the air supply and become liquified or condensed. This portion of fuel sometimes collects within the plenum chamber. Because of the step present between the runner and the lower wall, the liquified fuel can pool within the plenum chamber. When the outboard motor is trimmed, the fuel may spill into the lowermost intake runner, which alters the air-fuel ratio. The alteration of the air-fuel ratio can decrease engine performance or cause the engine to stumble.

SUMMARY OF THE INVENTION

It has been found that if the lowermost runner is lowered to be inline with the lower wall of the plenum chamber, the intake runner shape would have to be altered. The alteration would result in sharp corners, which would decrease the efficiency of the engine. Thus, such an alteration is not desired. An improved air intake system is desired that can reduce the amount of liquified fuel in the plenum chamber and that can release such liquified fuel into the combustion chamber in a more controlled manner. The improved system preferably also does not result in significantly adverse changes to the intake runner design.

Accordingly, one aspect of the present invention involves an outboard motor that comprises a cowling. An upper drive unit is positioned below the cowling. A bracket assembly is connected to the upper drive unit. The bracket assembly comprises a tilt shaft. An engine is positioned within the cowling. The engine comprises a generally vertically extending crankshaft and an engine body that comprises a combustion chamber. An air induction system comprises a plenum chamber and an intake runner that extends between the plenum chamber and the combustion chamber. The plenum chamber comprises a lower surface. The intake runner communicates with and extends from the plenum chamber generally above the lower surface such that a step is defined between the lower surface and an inner surface of the intake runner. The step defines a transition from the lower surface of the plenum chamber up to the inner surface of the intake runner. A groove extends between the step and the inner surface to allow movement of pooled residual liquid fuel from the plenum chamber to the intake runner. A substantial portion of the groove extends diagonally relative to the step and a section of the inner surface proximal the runner.

Another aspect of the present invention involves an outboard motor comprising a cowling. An upper drive unit is positioned below the cowling. A bracket assembly is connected to the upper drive unit. The bracket assembly comprises a tilt shaft. An engine is positioned within the cowling. The engine comprises a crankshaft with a generally vertical axis of rotation and two banks of combustion chambers. An air induction system comprises two plenum chambers. Each bank of combustion chambers comprises at least two combustion chambers. An intake runner extends to each combustion chamber from a wall of a respective one of the two plenum chambers. Each bank of combustion chamber comprises a lowermost combustion chamber and the associated intake runner defines a lowermost intake runner for that bank. A slot extends between an upwardly extending section of the wall of each plenum chamber and a section of the associated lowermost intake runner. Each slot is open along its length to the plenum chamber and the associated wall and the section of the associated lowermost intake runner proximal the wall.

A further aspect of the present invention involves an outboard motor comprising a cowling. An upper drive unit is positioned below the upper drive unit. A bracket assembly is connected to the upper drive unit. The bracket assembly comprises a tilt shaft. An engine is positioned within the cowling. The engine comprises a generally vertically extending crankshaft and an engine body that comprises a combustion chamber. An air induction system comprises a plenum chamber. An intake runner extends between the plenum chamber and the combustion chamber. The plenum chamber comprises a lower surface. The intake runner communicates with the plenum chamber generally above the lower surface such that a step is defined between the lower surface and an inner surface of the intake runner. The engine further comprising means for evacuating pooled liquified fuel from the plenum chamber to the intake runner.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise eight figures.

DETAILED DESCRIPTION OF THE PREFERRED EMBODIMENT

Figure 1:
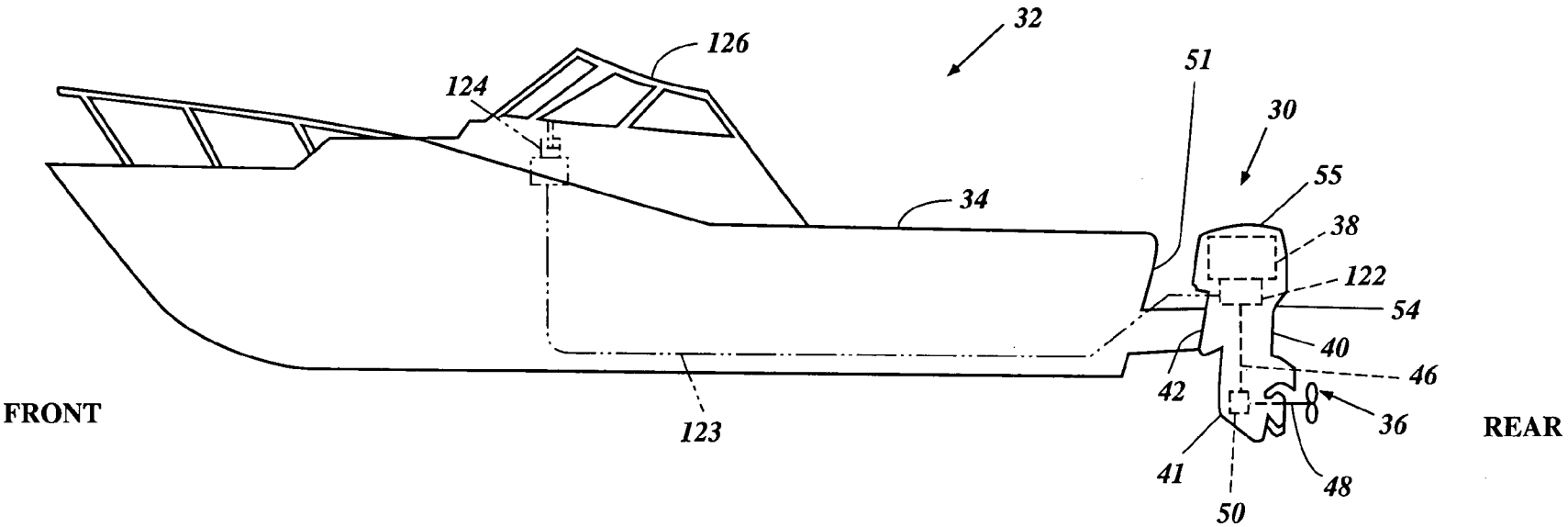
FIG. 1 is a schematic side elevation view of a watercraft including an outboard motor configured in accordance with a preferred embodiment of the present invention.
Figure 2:
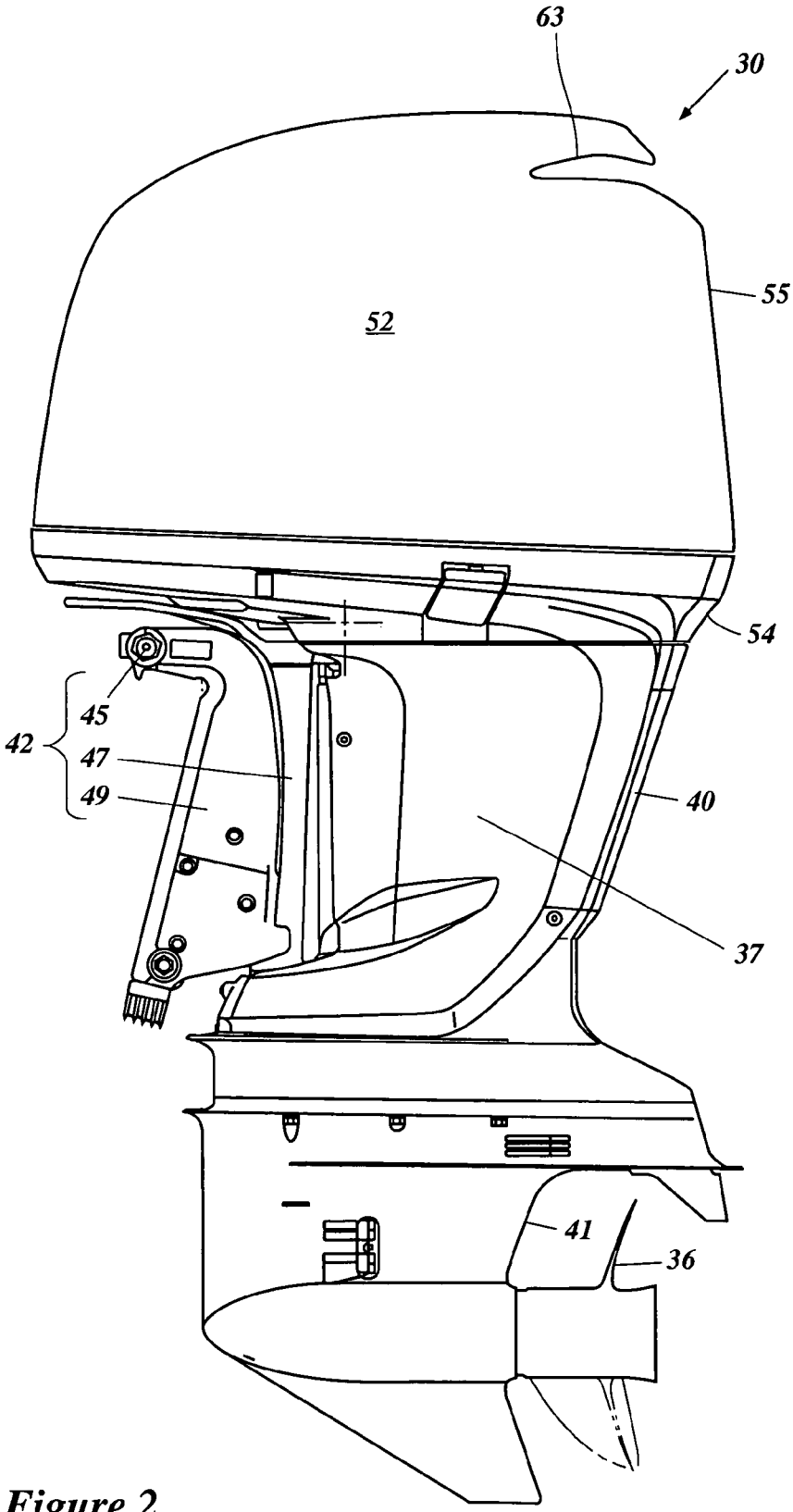
FIG. 2 is a side elevation view of the watercraft outboard motor, which includes a mounting bracket and a propeller. The external surface of the outboard motor is shown in detail.
Figure 3:
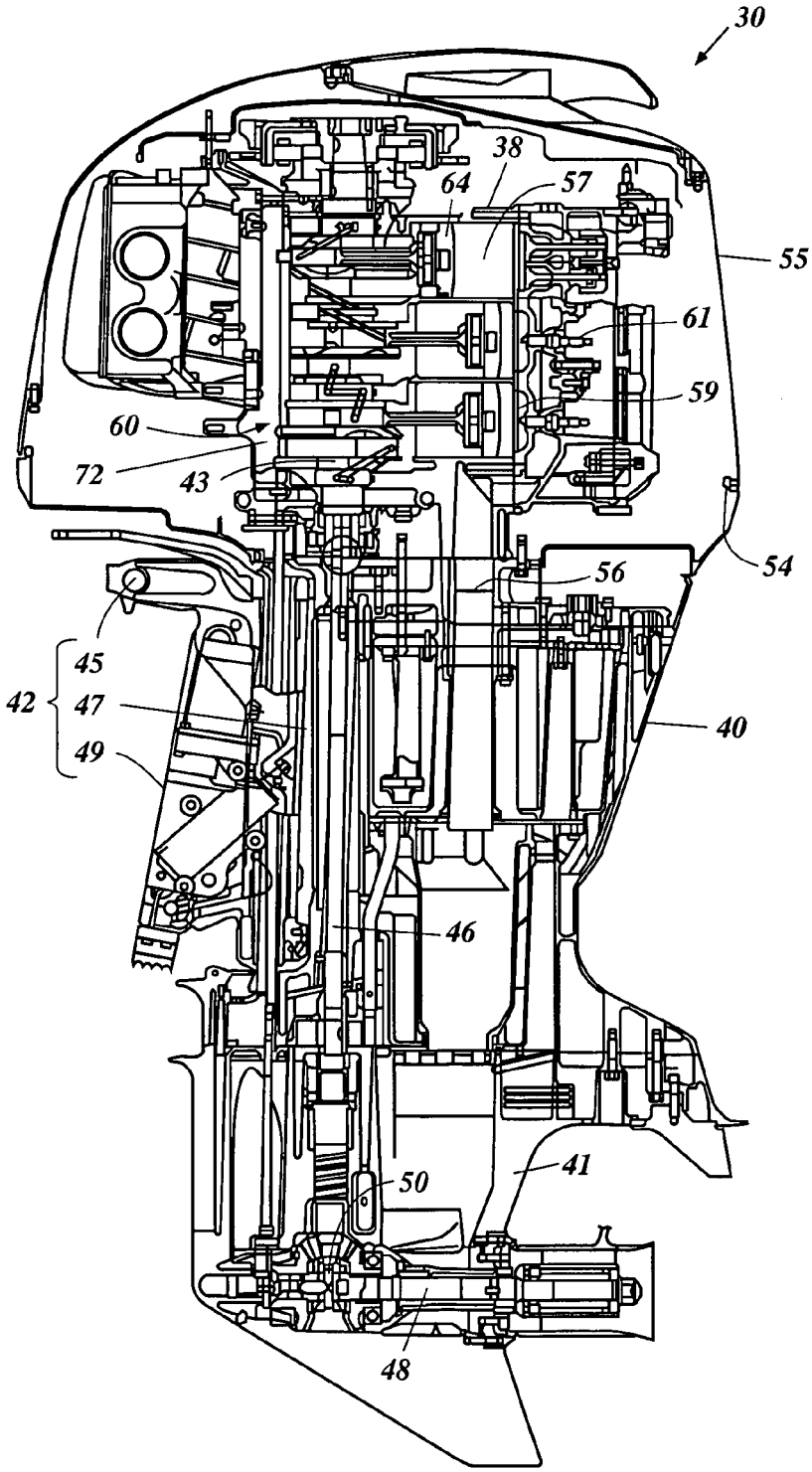
FIG. 3 is sectioned side elevation view of the watercraft outboard motor of FIG. 2 with the engine, a drive train, and various other internal components of the outboard motor shown in detail.

With reference to FIGS. 1–3, an outboard motor 30 that is configured in accordance with certain features, aspects and advantages of the present invention and an associated watercraft 32 are shown. Outboard motors are a typical type marine drive, and thus all the embodiments below are described in the context of an outboard motor. The embodiments, however, can be applied to other types of marine drives, such as, for example, inboard drives and inboard/outboard drives (or stem drives), as will become apparent to those of ordinary skill in the art.

With reference to FIG. 1, the watercraft 32 has a hull 34. The watercraft 32 carries the outboard motor 30 that has a propulsion device 36 and an internal combustion engine 38. The propulsion device 36 propels the watercraft 32 and the engine 38 powers the propulsion device 36. The propulsion device can take the form of a single propeller, a dual counter-rotating propeller system, a hydrodynamic jet, or any of a number of other suitable propulsion devices.

The outboard motor 30 comprises an upper drive unit 40 and a lower drive unit 41. The upper drive unit 40 houses the engine 38 and carries a bracket assembly 42. More specifically, the upper drive unit 40 comprises a drive shaft housing 37. The bracket assembly 42 is mounted to the drive shaft housing 37. The bracket assembly supports the outboard motor 30 on the hull transom 51. Preferably, the outboard motor is positioned such that the propulsion device 36 is placed in a submerged position when the watercraft 32 is at rest in a body of water. The lower drive unit 41, in turn, incorporates the propulsion device 36.

With reference to FIG. 2, the bracket assembly preferably comprises a pivot shaft 45, a swivel bracket 47, and a clamping bracket 49. The swivel bracket 47 allows the outboard motor 30 to be steerable from one side to the other and the pivot shaft 45 allows the outboard to be tilted or trimmed among a range of positions. Such constructions are well known in the art and any suitable construction can be used.

As used herein, the terms "forward," "forwardly," and "front" mean at or to the side labeled "FRONT" in FIG. 1, and the terms "rear," "reverse," "backward," and "rearward" mean at or to the side labeled "REAR" in FIG. 1, unless indicated otherwise or otherwise readily apparent from the context used. Additionally, the term "horizontally" means that members or components extend generally parallel to the water surface (i.e., generally normal to the direction of gravity) when the watercraft 32 is substantially stationary and the outboard motor is positioned in a generally "neutral" trim position (i.e., neither trimmed in or out); a rotational axis of the propulsion device lies generally parallel to the water surface when the outboard motor assumes the neutral trim position. The term "vertically" in turn means that proportions, members or components extend generally normal to those that extend horizontally.

The engine 38 is disposed atop the upper drive unit 40. The engine 38 preferably comprises an output shaft or a crankshaft 43 that extends generally vertically. A driveshaft 46 is coupled with the crankshaft 43 and extends generally vertically through the housing 37. The driveshaft 46 preferably is journaled for rotation within the housing 37. The crankshaft 43 drives the driveshaft 46. The lower drive unit 41 journals a propulsion shaft 48 for rotation. The propulsion shaft 48 extends generally horizontally through a lower portion of the housing. The driveshaft 46 and the propulsion shaft 48 are preferably oriented normal to each other (e.g., the rotation axis of propulsion shaft 48 is at 90° to the rotation axis of the driveshaft 46). The propulsion shaft 48 drives the propulsion device 36 through a transmission 50. A shift mechanism (not shown) associated with the transmission 50 changes the position of the transmission 50.

A protective cowling 52 preferably surrounds the engine 38. The protective cowling 52 comprises a bottom cowling member 54 and a top cowling member 55. The bottom cowling member 54 has an opening 56 through which an upper portion of the housing 37 or an exhaust guide member extends. The bottom cowling member 54 and the upper portion of the housing 37 together can define a tray. The engine 38 is placed onto this tray and is affixed thereto in any suitable manner.

The top cowling member 55 preferably is detachably affixed to the bottom cowling member 54 by a coupling mechanism so that a user, operator, mechanic or repairperson can access the engine 32 for maintenance or for other purposes. The top cowling member 55 preferably has an air intake opening 63 through which ambient air is drawn into a closed cavity around the engine 38.

Figure 5:
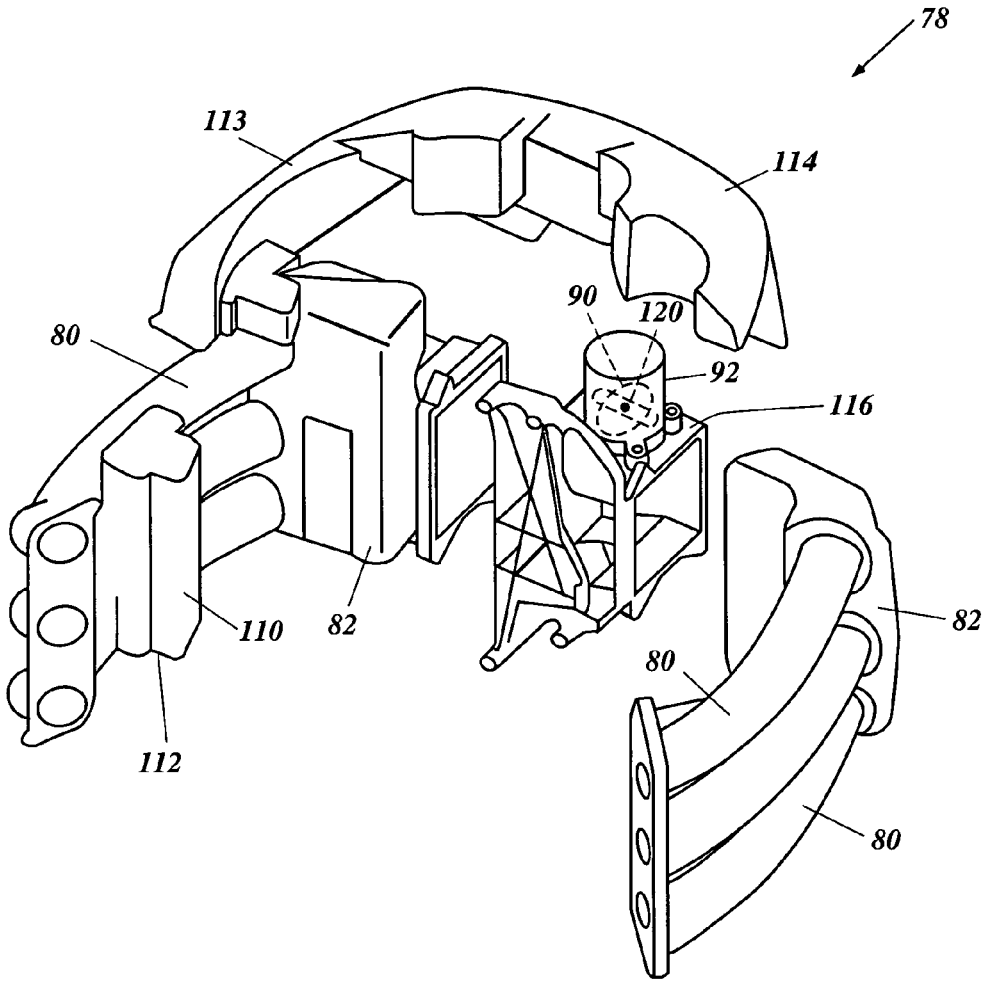
FIG. 5 is an exploded rear perspective view of the air intake system of FIG. 4 showing two plenum chamber housings, an intake silencer, a throttle housing, and an air intake support member.

Any type of conventional engines can be the engine 38 in the illustrated arrangement. Preferably the engine is an internal combustion engine such as that shown in FIG. 3. For this preferred type of engine, an air intake device draws the air in and delivers the air to one or more combustion chambers 59 of the engine 38. The intake device preferably has one or more throttle valves (see FIG. 5) to regulate the airflow to the combustion chambers 59.

A charge former such as, for example, a fuel injection system preferably supplies fuel to the combustion chambers 59 to form air/fuel charges in the combustion chambers. A control device such as, for example, an electronic control unit (ECU, not shown) preferably controls fuel injectors 58 to regulate an amount of fuel supplied to the engine 38 such that an air/fuel ratio can be suitably controlled.

A firing device having ignition elements 61 (e.g., spark plugs) exposed into the combustion chambers 59 preferably ignites the air/fuel charges in the combustion chambers under control of the ECU. Abrupt expansion of the volume of the air/fuel charges, which burn in the combustion chambers 59, moves pistons 64 located inside corresponding cylinder bores 57. The pistons 64 are connected to the crankshaft 43 and rotate the crankshaft, which drives the driveshaft 46.

An exhaust device routes exhaust gases in the combustion chambers to an external location of the outboard motor 30. Unless the environmental circumstances change, an engine speed of the engine 38 increases generally along with an increase of the amount of the air or airflow rate. The engine 38 will be explained in greater detail below.

The transmission 50 preferably comprises a drive pinion, a forward bevel gear and a reverse bevel gear to couple the two shafts 46, 48. The drive pinion is disposed at the bottom of the driveshaft 46. The forward and reverse bevel gears are disposed on the propulsion shaft 48 and are spaced apart from each other. Both bevel gears always mesh with the drive pinion. The bevel gears, however, race on the propulsion shaft 48 unless fixedly coupled with the propulsion shaft 48. A suitable clutching arrangement can be used to selectively couple the bevel gears to the shaft 48.

Figure 4:
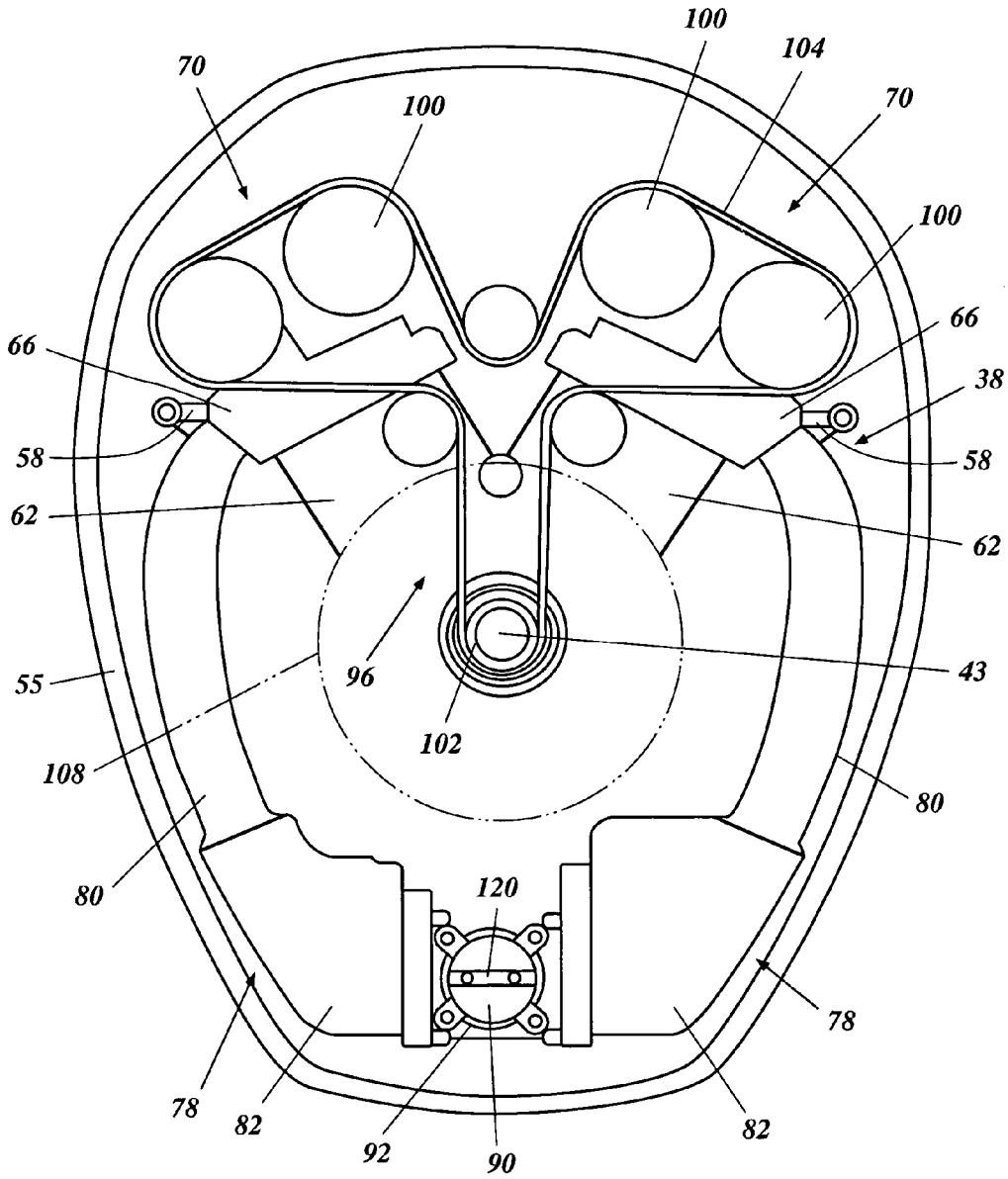
FIG. 4 is a top plan view of the engine of FIG. 2 and illustrates a portion of an air intake system as well as a camshaft drive mechanism.

With reference to FIG. 4, a top plan view of the outboard motor 30 is illustrated. The internal combustion engine 38 is located within the top cowling member 55. The engine 38 thereby is generally protected by the top cowling member 55 from environmental elements. The engine 38 in the illustrated embodiment preferably operates on a four-cycle combustion principle. The illustrated engine is a DOHC (double overhead cam) six-cylinder engine having a V-shaped cylinder block 60. The cylinder block 60 thus defines two cylinder banks 62, which lie generally next to each other. In the illustrated arrangement, each cylinder bank 62 has three cylinder bores 57 such that the cylinder block has six cylinder bores in total. The cylinder bores 57 of each bank extend generally horizontally and are generally vertically spaced apart from one another. This type of engine, however, merely exemplifies one type of engine. Engines having other numbers of cylinders, having other cylinder arrangements (in line, opposing, etc.), and operating on other combustion principles (e.g., two-stroke or rotary) can be used in other embodiments.

The reciprocating piston 64 moves relative to the cylinder block 60 in a suitable manner. In the illustrated arrangement, the piston reciprocates within each cylinder bore 57. Because the cylinder block 60 is split into the two cylinder banks 62, each cylinder bank 62 extends outward at an angle and terminates at an outer end of the bank 62. A pair of cylinder head members 66 is fixed to the respective outer ends of the cylinder banks to close those ends of the cylinder bores. The cylinder head members 66 together with the associated pistons and cylinder bores provide the six combustion chambers 59. Of course, the number of combustion chambers can vary. A cylinder head cover member 70 covers each of the cylinder head members 66. In some arrangements, the cylinder head cover members 70 can be unitarily formed with the respective cylinder head members 66.

A crankcase member 72 is coupled with the cylinder block 60 on the front side of the illustrated cylinder block 60 and a crankcase cover (not shown) is further coupled with the crankcase member 72. The crankcase member 72 and a crankcase cover close the other end of the cylinder bores and, together with the cylinder block 60, define a crankcase chamber. The crankshaft 43 extends generally vertically through the crankcase chamber and is journaled for rotation about a rotational axis by several bearing blocks. Connecting rods couple the crankshaft 43 with the respective pistons 64 in any suitable manner. In any event, reciprocal movement of the pistons preferably causes rotation of the crankshaft 43. In some arrangements, the crankcase cover member can be unitarily formed with the crankcase member 72. Thus, the cylinder heads, cylinder block and crankcase member together define at least a portion of a body of the engine 38.

The engine 38 also comprises an air intake system 78. The air intake system 78 draws air from outside the engine, preferably from within the closed cavity or an air passage within the closed cavity, and supplies the air to the combustion chambers 59. The illustrated air intake system 78 comprises six intake passages defined at least in principal part by intake runners or conduits 80 and a pair of plenum or expansion chambers 82. In the illustrated arrangement, each cylinder bank communicates with three intake passages 80 and one plenum chamber 82. Other suitable arrangements are possible. The air within the closed cavity is drawn into the plenum chamber 82. The air expands within the plenum chamber 82 to reduce pulsation and then enters the intake runners 80. The air passes through the intake runner 80 and flows toward the combustion chambers and ports that are located in each cylinder head member 66.

The most downstream portions of the intake passages 80 are defined within the cylinder head member 66 as inner intake passages (not shown). The inner intake passages communicate with the combustion chambers 59 through intake ports, which are formed at inner surfaces of the cylinder head members 66. Typically, each of the combustion chambers 59 has one or more intake ports. Intake valves are disposed at each cylinder head member 66 to move between an open position and a closed position.

The intake valves act to open and close the ports to control the flow of air into the combustion chambers 59. Biasing members, such as springs, are used to urge the intake valves toward their respective closed positions by acting between a mounting boss formed on each cylinder head member 66 and a corresponding retainer that is affixed to each of the valves. When each intake valve is in the open position, the inner intake passage thus associated with the intake port communicates with the associated combustion chamber.

In the illustrated embodiment, a valve cam drive mechanism 96 preferably is provided for actuating the intake and exhaust valves in each cylinder bank. In the embodiment shown, the valve cam mechanism 96 includes second rotatable members such as a pair of camshafts disposed in the cylinder head 66 of each cylinder bank 62. The camshafts typically comprise intake and exhaust camshafts that extend generally vertically and are journaled for rotation generally between the cylinder head members 66 and the cylinder head cover members 70. The camshafts have cam lobes (not shown) to push the respective ends of the intake and exhaust valves in any suitable manner. The cam lobes repeatedly push the valves in a timely manner in proportion to the engine speed. The engine can also include a variable valve timing mechanism. In one form of such a mechanism, a hydraulic actuator can cooperate with one or more of the camshafts to adjust valve timing, as well known in the art. Of course, other types of valve actuating mechanisms (e.g., hydraulic or electric) can be used to control the amount and timing of air flow into the combustion chambers.

The illustrated camshaft drive mechanism 96 includes driven sprockets 100 positioned atop at least one of each pair of camshafts, a drive sprocket 102 positioned atop the crankshaft 43 and a flexible transmitter, such as a timing belt or chain 104. The flexible transmitter 104 is wound around the driven sprockets 100 and the drive sprocket 102. The crankshaft 43 thus drives the respective camshaft through the timing belt 104 in the timed relationship.

A throttle valve 90 mounted inside a throttle valve assembly 92 regulates the amount of airflow allowed to enter the plenum chamber 82 and ultimately into the intake passages 80; however, other throttle valve placements and other types of flow control devices can be used as well to regulate air flow to the engine. For instance, more than one throttle valve 92 can be used. Other components of the air intake system 78 will be described in detail below.

The engine 38 may include other systems, mechanisms, devices, accessories, and components other than those described above such as, for example, a cooling system and a starter motor. The illustrated engine further comprises a lubrication system to lubricate the moving parts within the engine 38. The lubrication system can be a pressure fed system. A flywheel assembly 108, which is schematically illustrated with phantom line in FIG. 4, can be provided and preferably is positioned atop the crankshaft 43. The flywheel preferably rotates with the crankshaft 43. The flywheel assembly 108 can include a flywheel magneto that supplies electric power directly or indirectly via a battery to various electrical components, such as to the fuel injection system, the ignition system and the ECU. The crankshaft 43 also can directly or indirectly drive any of a number of other systems, mechanisms, devices, accessories, and components. For example, the crankshaft 43 can drive a water pump of open-loop or closed-loop cooling systems via the driveshaft, as well known in the art.

A preferred embodiment of the air intake system 78 will now be described in greater detail. In the illustrated embodiment, which is best described with reference to FIGS. 4–8, air enters the air intake system 78 through an intake opening 112 of an intake channel 110 (see FIG. 5). The intake opening 112 is disposed near the bottom of the engine 38 in the illustrated embodiment. The intake channel 110 communicates with a side portion 113 of an intake silencer 114. The intake silencer 114 guides the inducted air to the throttle valve assembly 92 where the throttle valve 90 regulates the amount of air flowing through the throttle valve assembly 92. Heat from the engine, which rises to the top of the protective cowling 55, allows for cooler, denser air to be drawn into the air intake system. The inducted intake air is guided into an air intake support member 116 after passing through the throttle valve assembly 92. The air flows from the air intake support member 116 to each plenum chamber 82. Pulses from the inducted air are reduced in the plenum chambers 82 and the air flows into the respective intake air passages 80. While the illustrated embodiment employs one intake silencer 114 and one intake opening 112, a plurality of intake silencers and/or a plurality of intake openings can be used with the present induction system.

The throttle valve assembly 72 is mounted to the air intake support member 116. Preferably, the throttle valve 90 is a butterfly valve that has a valve shaft 120 journaled for pivotal movement about generally horizontal axis. A control linkage 123 (FIG. 1) is connected to an operational member, such as a throttle lever 124, that is provided on a control deck 126 or otherwise proximate the operator of the watercraft.

The operator can control the opening degree of the throttle valve 90 through a throttle valve control mechanism 122 in accordance with operator request through the control linkage 123. That is, the throttle valve assembly 92 can measure or regulate amounts of air that flow through intake passages 80 through the combustion chambers 68 in response to the operation of the operational member by the operator. Normally, the greater the opening degree, the higher the rate of air-flow and the higher the engine speed. While the illustrated embodiment employs only a single throttle valve, the intake system can use a plurality of throttle valves that operate in parallel to regulate air flow into the plenum chambers. The chambers, in this arrangement, can be isolated from each other or can communicate with each other (such as, for example, via the intake support member) to balance air pressure.

The respective intake runners 80 extend forwardly along side surfaces of the engine 38 on both the port side and the starboard side from the respective cylinder head members 66. In the illustrated embodiment, the intake runners 80 terminate generally at the front of the crankcase 72. The intake runners 80 on the same side extend generally parallel to each other and are vertically spaced apart from one another.

The respective plenum chambers 82 are connected with each other through the air intake support member 116, which substantially equalizes the internal pressures within each chamber 82. The plenum chambers 82 coordinate or smooth air delivered to each intake passage 80 and also act as silencers to reduce intake noise.

The intake runners 80 are connected to the respective plenum chambers 82. The illustrated air intake passages 80 generally expand or flare outward proximate the plenum chamber 82. The resulting bell shape defines a larger diameter opening 130 at the connection to the plenum chamber 82. The larger diameter opening 130 also is advantageously curved, which allows air to flow into the air intake passages 80 easier. Thus, the bell shaped ends are believed to result in increased volumetric efficiency. Stated another way, the curved transition of the air intake passage 80 with the plenum chamber 82 are believed to decreases surface friction, which allows the air to more easily enter the air intake passages 80 at a higher flow rate.

Figure 7:
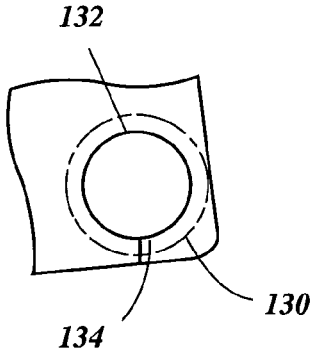
FIG. 7 is side elevation view of one of the intake passages (as viewed looking toward the plenum chamber) illustrating a groove that communicates with the lowermost intake passage.

FIG. 7 illustrates a view from the lower air intake passage 132 as seen toward the plenum chamber 82. A dashed circular line illustrates the larger outer diameter opening 130 of the air intake passage 80 where the air intake passage meets the plenum chamber 82. A transition area 136 is located where the air intake passage 80 meets the plenum chamber 82. The transition area 136 from a smaller diameter of the lower air intake passage 132 to the larger diameter opening 130 of the air intake passage 80 is curved to allow an increase in air flow into the engine 38.

Figure 6:
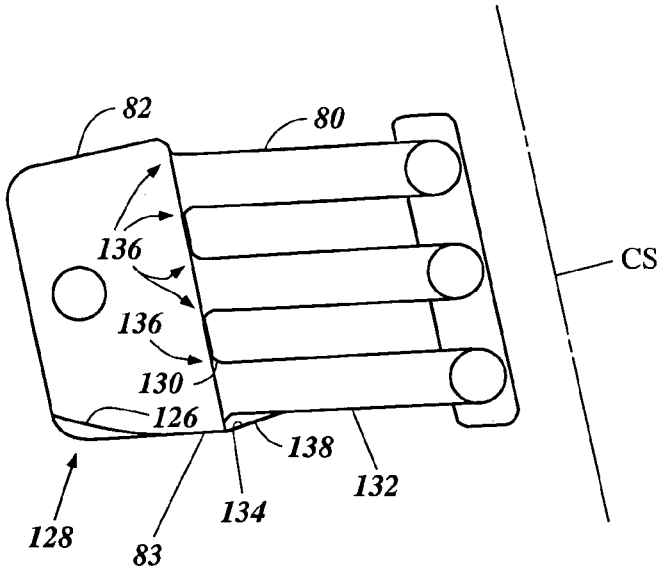
FIG. 6 is a side elevation view of one of the plenum chambers and three intake passages. This view shows liquid fuel that has collected at one end of the plenum chamber.
Figure 8:
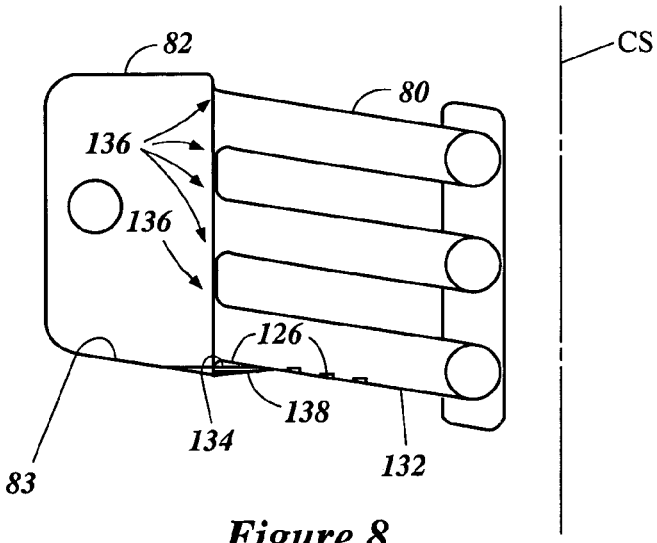
FIG. 8 is another side elevation view of one of the plenum chambers and three intake passages. This view shows a controlled release of pooled liquid fuel from the plenum chamber.

As illustrated in FIGS. 6 and 8, the lowermost intake runner or passage 132 is positioned above a lowermost surface 83 of an interior of the plenum chamber 82. In some arrangements, the lowermost surface 83 may pitch downward toward a generally vertical longitudinal centerplane of the lowermost runner 132. In this manner, the lowermost surface 83 may slope such that liquified fuel will tend to travel toward the region of the lowermost intake runner 132.

With reference now to FIG. 7, the lowermost air intake passage 132 advantageously incorporates a slot 134, groove or other passageway. The slot 134 preferably is located in a lower portion of passage 132. In the illustrated arrangement, the slot 134 extends through a thickened portion of the lowermost runner 132, proximate the region in which the runner is bell shaped. Preferably, the slot 134 extends generally linearly from the bottom surface 83 to a predetermined portion of the intake pipe 132, which portion is downstream of the flared end of the pipe 132. As illustrated, the slot 134 controls the amount of liquified fuel 126 that can pool within the plenum chamber 82 and provides some degree of metering of the pooled fuel 126 during the rather slow trimming movements of the outboard motor. In short, the slot 134 or channel allows the residual condensed fuel 126 to travel from the plenum chamber 82 into the engine through the lower intake passage 132.

The slot 134 defines a channel or passageway through the step defined between the bottom surface 83 and the lowermost runner 132. The slot 134 can be configured with a rectangular cross-section, a triangular cross-section, or a semi-circular cross-section, if desired. Other shapes also are possible. Moreover, the slot 134 can be formed integrally with the runner or separate from the runner and attached.

In the illustrated arrangement, the bottom surface 83 pitches toward the runners and the lowermost runner pitches slightly downward from the plenum chamber 82 toward the cylinder head. As such, the illustrated slot 134 slopes slightly upward from the bottom surface 83 toward the cylinder head. As described above, such a configuration provides a more limited outlet for the pooled fuel such that the escaping fuel is more slowly introduced into the combustion chamber.

The slot 134 allows the residual condensed fuel 126 to enter the combustion chambers 68 at a predetermined rate. The predetermined rate at which the condensed residual fuel 126 is allowed to enter the combustion chambers 68 is rather minute and does not significantly effect the air/fuel mixture ratio. The slot 134 simply allows the condensed residual fuel to enter the lower air intake passages 132 when the outboard motor 30 is in a normal operating position to reduce the amount of residual liquified fuel 126 that can accumulate within the plenum chambers 82. Thus, the slot 134, or a similar passageway, channel, canal, groove, recess, capillary tube, tunnel, pipe or the like, that is positioned proximate the bottom of the plenum chamber, that has a limited cross-section and that communicates with an intake runner defines a means for evacuating pooled liquified fuel from the plenum chamber to an intake runner.

For example, with reference to FIG. 6, if the outboard motor 30 is positioned in a tilted back position for transporting and/or service, an amount of condensed fuel 126 can accumulate at an area 128 located at the bottom front portion of the plenum chamber 82. The line CS represents an inclined crankshaft rotational axis. FIG. 8 illustrates the outboard motor 30 located in the normal operating position. The generally vertical line CS represents a generally vertical crankshaft rotational axis. When the outboard motor 30 is placed in the normal operating position, the condensed fuel 126 moves forward in the plenum chamber 82 and the fuel is slowly released into the lowermost runner 132. As illustrated, the runner 132 and the bottom surface 83 slope downward relative to the crankshaft and the illustrated groove 134 slopes slightly upward relative to the crankshaft.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, the air intake system can be employed on engines used to propel other types of vehicles (e.g., personal watercraft, automobile, ATV and the like). Moreover, not all of the features, aspects and advantages are necessarily required to practice the present invention. Accordingly, the scope of the present invention is intended to be defined only by the claims that follow.

What is claimed is:

1. An outboard motor comprising a cowling, an upper drive unit positioned below said cowling, a bracket assembly connected to said upper drive unit, said bracket assembly comprising a tilt shaft, an engine positioned within said cowling, said engine comprising a generally vertically extending crankshaft and an engine body comprising a combustion chamber, an air induction system comprising a plenum chamber, an intake runner extending between said plenum chamber and said combustion chamber, said plenum chamber comprising a lower surface, said intake runner communicating with and extending from said plenum chamber generally above said lower surface such that a step is defined between said lower surface and inner surface of said intake runner, the step defining a transition from the lower surface of the plenum chamber up to the inner surface of the intake runner, and a groove formed in a section where the intake runner extends from the plenum chamber and extending between said step and the inner surface to allow movement of pooled residual liquid fuel from said plenum chamber to said intake runner, wherein a substantial portion of the groove extends diagonally relative to said step and a section of the inner surface proximal said step.

2. The outboard motor of claim 1, wherein said intake runner comprises a flared end proximate said plenum chamber and said groove extends generally linearly from said lower surface to a portion of said intake runner downstream of said flared portion.

3. The outboard motor of claim 1, wherein said groove extends at an angle relative to said lower surface.

4. The outboard motor of claim 1, wherein said groove is generally rectangular in cross-section.

5. The outboard motor of claim 1, wherein said lower surface slopes toward said runner and said groove extends upward at an angle relative to said lower surface of said plenum chamber.

6. The outboard motor of claim 1 wherein said intake runner slopes downward relative to a rotational axis of said crankshaft.

7. The outboard motor of claim 6, wherein said lower surface slopes downward relative to said rotational axis of said crankshaft.

8. The outboard motor of claim 7, wherein said groove slopes upward relative to said rotational axis of said crankshaft.

9. An outboard motor comprising a cowling, an upper drive unit positioned below said cowling, a bracket assembly connected to said upper drive unit, said bracket assembly comprising a tilt shaft, an engine positioned within said cowling, said engine comprising a crankshaft with a generally vertical axis of rotation and two banks of combustion chambers, an air induction system comprising two plenum chambers, each bank of combustion chambers comprising at least two combustion chambers, an intake runner extending to each combustion chamber from a wall of a respective one of said two plenum chambers, each bank of combustion chamber comprising a lowermost combustion chamber and said associated intake runner defining a lowermost intake runner for that bank, and a slot extending between an upwardly extending section of the wall of each plenum chamber and a section of said associated lowermost intake runner, each slot being open along its length to the plenum chamber and the associated lowermost intake runner, wherein a substantial portion if each slot extends diagonally relative to the associated wall and said section of the associated lowermost intake runner proximal the wall.

10. The outboard motor of claim 9, wherein each said plenum chamber comprises a bottom surface and a first end of said respective slot is generally aligned with said bottom surface.

11. The outboard motor of claim 9, wherein said slot has a generally rectangular cross-section.

12. The outboard motor of claim 9 further comprising a throttle body that is positioned generally laterally between said plenum chambers.

13. The outboard motor of claim 9, wherein each said plenum chamber comprises a bottom surface, said intake runners comprise flared ends proximate said respective plenum chamber and said respective slot extends generally linearly from said bottom surface to a portion of said respective lowermost intake runner downstream of said flared portion.

* * * * *

UNITED STATES PATENT AND TRADEMARK OFFICE

CERTIFICATE OF CORRECTION

PATENT NO. : 7,090,552 B2
APPLICATION NO. : 10/880184
DATED : August 15, 2006
INVENTOR(S) : Goichi Katayama It is certified that error appears in the above-identified patent and that said Letters Patent is hereby corrected as shown below:

Column 2

Line 29, after "associated" insert --lowermost intake runner. A substantial portion of each slot extends diagonally relative to the associated--.

Column 9

Line 61, in Claim 1, after "and" insert--an--.

Column 10

Line 46, In Claim 9, delete "if" and insert --of --, therefore.

Signed and Sealed this

Eighteenth Day of September, 2007

JON W. DUDAS
*Director of the United States Patent and Trademark Office*